United States Patent [19]

Isgrig

[11] 4,101,127

[45] Jul. 18, 1978

[54] TARGET AMUSEMENT DEVICE

[76] Inventor: Glenn W. Isgrig, 7735 Tecumseh Trail, Cincinnati, Ohio 45243

[21] Appl. No.: 799,383

[22] Filed: May 23, 1977

[51] Int. Cl.[2] ..... A63F 9/14; F41J 3/02

[52] U.S. Cl. ..... 273/95 B; 273/262; 273/106 E; 273/102.1 G

[58] Field of Search ..... 273/95 B, 130 D, 86 R, 273/86 D, 86 F, 1 R

[56] References Cited

U.S. PATENT DOCUMENTS

| | | | |
|---|---|---|---|
| D. 141,207 | 5/1945 | Isgrig | D34/15 R |
| 1,153,395 | 9/1915 | Lehman | 273/134 AD |
| 1,958,563 | 5/1934 | Brooker et al. | 273/86 D |
| 2,300,132 | 10/1942 | New | 273/101.2 |
| 2,452,817 | 11/1948 | Whipple et al. | 273/95 B |
| 2,793,860 | 5/1957 | De Crescenzo | 273/95 B |
| 2,954,229 | 9/1960 | Schumacher et al. | 273/95 B |
| 3,353,829 | 11/1967 | Board | 273/130 D |
| 3,594,002 | 7/1971 | Glass | 273/1 R |
| 3,853,318 | 12/1974 | Cagan | 273/102.1 C |

FOREIGN PATENT DOCUMENTS

| | | | |
|---|---|---|---|
| 313,795 | 6/1956 | Switzerland | 273/95 B |

*Primary Examiner*—Richard C. Pinkham
*Assistant Examiner*—Lawrence E. Anderson
*Attorney, Agent, or Firm*—Wood, Herron & Evans

[57] ABSTRACT

An amusement device includes a target board having a plurality of paths and associated targets thereon, and a projectile aiming and releasing apparatus for accurately dropping an aimed, blunt projectile onto the target board. Position indicating pieces are moved about the path in response to hits or misses of specific targets by each player, one trying to move his piece through a primary path in the lowest number of "shots" while the other attempts to hit targets obstructing or interrupting such movement. Improved projectile aiming and releasing apparatus provides an upwardly directed target image with adjustable cross-hairs imposed thereon.

13 Claims, 9 Drawing Figures

TARGET AMUSEMENT DEVICE

This invention relates to amusement devices and more particularly to an aimed projectile and target board game.

Amusement devices, including projectile aiming and releasing apparatus in combination with a game board, having targets thereon, are well known in the art. For example, U.S. Pat. Nos. 2,452,817; 2,954,229; and U.S. Design Pat. No. 141,207 disclose related devices.

I now desire, however, to provide an improved accurate projectile aiming and releasing apparatus together with an improved and unique target board having a plurality of targets which differ in size and elevation and which dictate moves of a position piece throughout predetermined paths on the target board.

Accordingly, it has been one objective of the invention to provide an improved target board and improved projectile aiming and releasing apparatus.

A further objective of the invention has been to provide a target board having path defining indicia thereon and target apparatus directing movement of a position piece along said path in response to a hit thereon by a projectile.

A further objective of the invention has been to provide a driven element for moving a position piece through a portion of a path on a target game board, and a target area proximate said path and obstructing, in combination with a projectile therein, movement of the driven element.

A still further objective of the invention has been to provide an amusement device having an improved projectile aiming and releasing apparatus adjustably providing an actual, properly oriented, target image with cross-hairs imposed thereon.

To these ends, a preferred embodiment of the invention includes a target or game board and path defining indicia thereon. A position piece, such as a toy car, is movable along the path as directed by hits of a dropped projectile on appropriate targets associated with the path. Alternate paths, defining a longer route to the common destination point may be taken by hitting larger targets, while the shorter primary path requires hits on smaller targets. At various path positions, a player's opponent is given the opportunity to drop an aimed projectile on special targets operable to obstruct or interrupt movement of the player's position piece.

At one point in the primary path, a player may mount his position piece on a movable driven element and release it for a direct move to the destination point. The opponent is given one opportunity to drop a projectile onto a target in the path of the driven element and thus stop it.

A player's score is the total number of projectiles dropped, plus any penalties resulting from an opponent's hitting specific obstructing or interrupting targets.

The targets directing movement of a player's position piece preferably comprise holes in the target board along the path defining indicia. A safe projectile such as a blunt rod is utilized, eliminating the utilization of any unsafe sharply pointed projectile.

An improved projectile aiming and releasing apparatus includes an inclined projectile tube, for initiating a consistent projectile path, and an adjustable sighting system, including four reflecting mirrors which project an actual target image, in appropriate orientation, upwardly for comfortable viewing. Cross-hairs, by which the projectile is aimed, are imposed on the target image. Targets on the board are disposed at different levels, the height differences resulting in a parallax inaccuracy which each player must adapt to, thereby lending more difficulty to the game.

The target board is also provided with a testing area including a large target of a yieldable substance, such as modeling clay, for "sighting in" the aiming apparatus. Initial positioning apparatus is provided for locating the aiming and release apparatus for "sighting in".

The invention thus provides a highly accurate and consistent apparatus for aiming and releasing a projectile to hit a very small target. The projectile is blunt, not pointed, and is safer than projectiles of the pointed type. Moreover, since targets are provided at different levels, and even though the projectile aiming and release apparatus is highly accurate, each player is required to make his own parallax adjustments, thereby requiring skill to play the game well. Also, the aiming structure provides an actual, correctly oriented target image projected in a direction comfortable for viewing.

These and other objects and advantages will become readily apparent from the following detailed description of a preferred embodiment and from the drawings in which.

Game and Board

Figure 1:
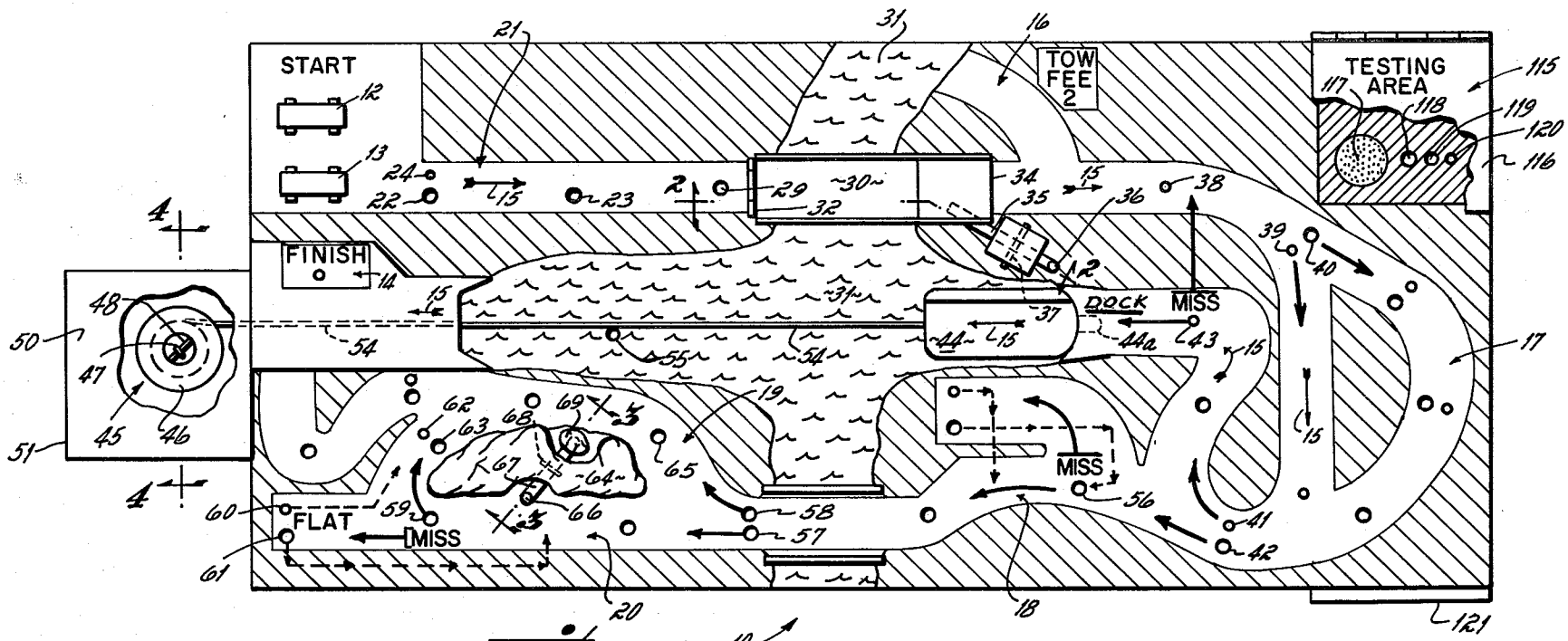
FIG. 1 is a diagrammatic plan view of a target board in accordance with the invention.
Figure 5:
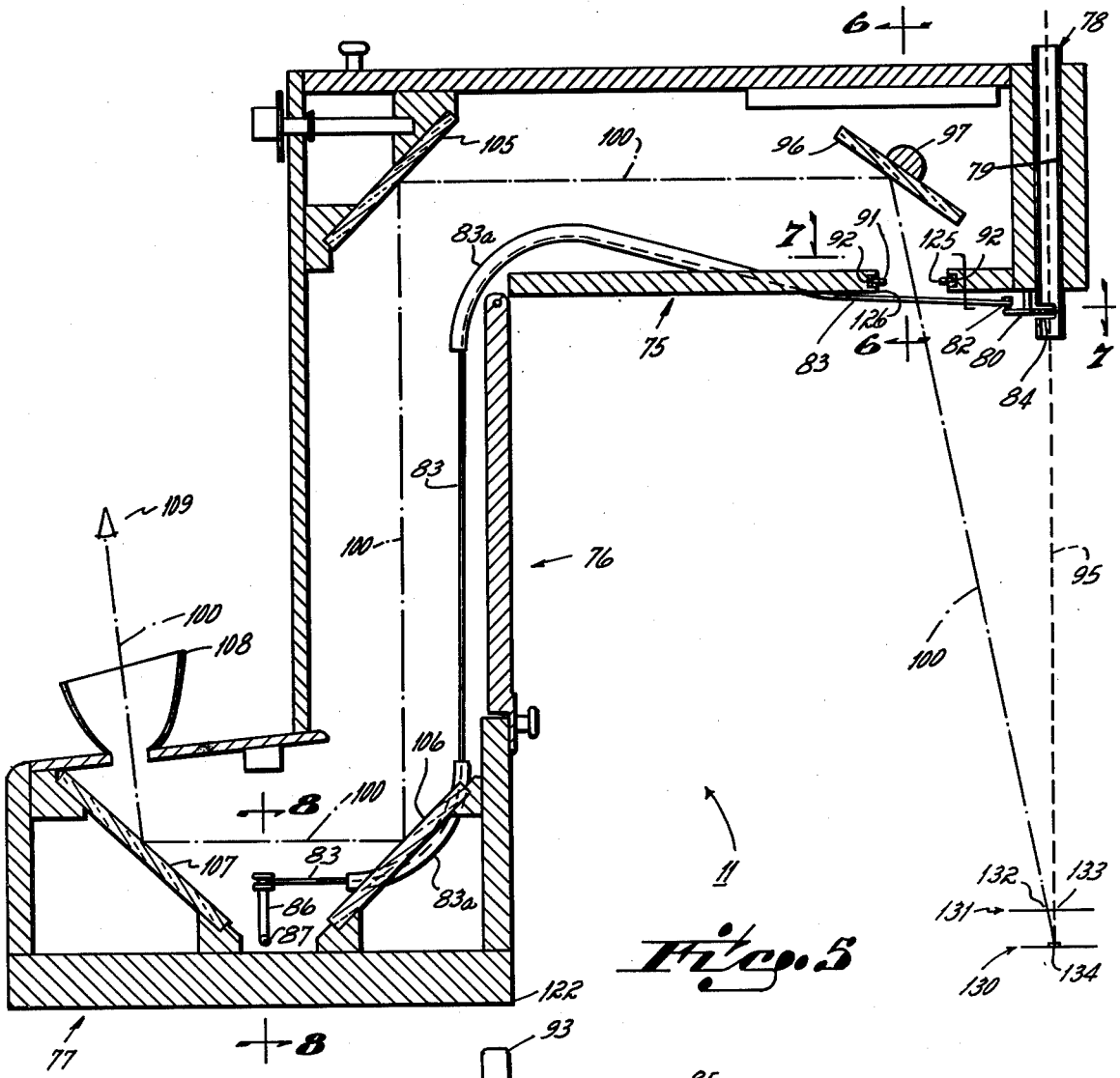
FIG. 5 is a cross-sectional view of a projectile aiming and releasing apparatus according to the invention.

Turning now to the drawings, the amusement device according to the present invention includes a game or target board 10, as shown in FIG. 1, and a projectile aiming and releasing apparatus 11, as shown in FIG. 5. The game board 10 is provided with movable position indicating pieces, such as toy cars diagrammatically indicated at 12 and 13 in FIG. 1. The target board 10 is also provided with path defining indicia and targets associated therewith as will hereinafter be described.

The object of the game is for one player to move his position indicating piece throughout a path by hitting movedirecting targets with a projectile aimed and released from the projectile aiming and releasing apparatus 11. The player who moves his position indicating piece to the common destination or finish point 14 with the least number of projectile releases and penalties is the winner.

In a preferred embodiment of the invention, the target board 10 is set up to symbolize a sports car economy run with each projectile release and each penalty being representative of a gallon of gas. Thus, the winning player is the one who moves his position indicating piece from start to finish 14 with the least number of gallons of gas.

More particularly, the target board 10 is provided with first primary path defining indicia indicated by the arrows 15, and with respective alternate path indicia as at 16, 17, 18, 19 and 20. A plurality of targets comprising holes on the target board 10 are located proximate the primary and alternate paths 15 and 16 through 20, respectively. Targets can be disposed adjacent the respective paths, or on the paths in order to define progressive spaces for movement of the position indicating pieces. In many locations, at least two targets define each space. For example, a single space 21 is defined near the start of the path 15 by large targets 22 and 23 respectively, and by small target 24, the space being between the targets 22, 24 and target 23. Hitting the larger targets 22 or 23 permit the position indicating piece to be moved forward one space only, while hitting the harder to hit small target 24 permits the positioning indicating piece to be moved two spaces or to take advantage of a route requiring fewer shots as will be described.

The primary path 15 is the shortest path to the common finish 14. Alternate paths, however, can be selected either by the player choosing and hitting a larger target along the path, or as required by the player's opponent hitting specified targets along the path.

Figure 9:
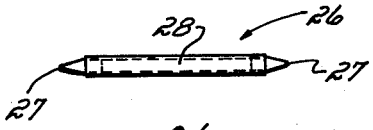
FIG. 9 is an illustrative view of a projectile according to the invention.

To facilitate a better understanding of the invention, the structure of the target board 10 will now be described in connection with a description of the progress of play in a typical game. A first player selects a position indicating piece 12 or 13 and moves it along primary path 15 by hitting either the smaller target 24 or the larger target 22 with a projectile 26 as shown in FIG. 9. The preferred projectile comprises a wooden rod having rounded ends 27 and being encased in a relatively thin metallic tube 28 which adds to the weight of the projectile. The ends 27 of the projectile are rounded and are of such a size as to fit within the smaller target 24, etc., or within the larger targets 22, 23, etc. Thus, the first player advances his position indicating piece by dropping the projectile from the projectile aiming and release apparatus 11 into the targets along the path 15.

Figure 2:
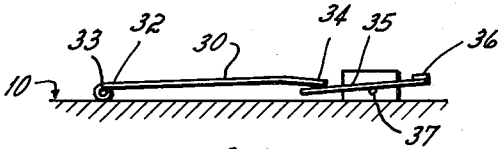
FIG. 2 is a cross-sectional view taken along lines 2—2 of FIG. 1.

Upon reaching several spaces from "start", dropping a projectile into the target 29 permits the player to move his position indicating piece onto the bridge 30 which is constructed over water indicating indicia 31. The bridge 30 is hinged at end 32 to pivot about pivot axis 33. The other free end 34 of bridge 30 rests on one end of a lever arm 35, all as shown in FIG. 2. Lever arm 35 is provided on one end with a target 36 which, as shown in FIG. 2, is located above target board 10. As will be understood from FIGS. 1 and 2, a hit on target 36 with a projectile 26 will cause the lever arm 35 to pivot clockwise about pivot point 37 and thus flip the bridge around pivot axis 33, this action knocking the position indicating piece into the water 31.

If the opponent misses the target 36, the driver moves to the first space beyond the bridge and up to target 38. If the opponent hits the target 36, the driver-player must record one extra shot to return to the front of the bridge, that is, upstream of target 29. Alternately, he may take a two shot penalty and place his position indicating piece at the first space beyond the bridge.

At the smaller and larger targets 39 and 40, respectively, the driver-player must decide to take primary path 15 or alternate path 17. By hitting the smaller target he continues on path 15. By hitting the larger target 40, he must take alternate path 17. He then moves his piece either one or two spaces, depending on whether the smaller or larger target was hit, in the direction of the arrows associated with the targets 39 and 40. It will be noted that alternate path 17 includes more targets than does the path 15 at this area, and thus constitutes a longer distance to the common destination point 14 [Finish].

Figure 4:
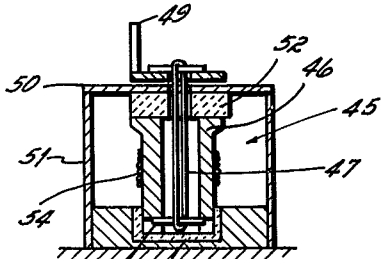
FIG. 4 is a cross-sectional view taken along lines 4—4 of FIG. 1.

Once the driver has reached the space fronted by small and large targets 41 and 42, he makes another decision to continue on the land route, indicated by the alternate path designations 18, 19 or 20, or to try to hit the smaller target 41 and continue on the primary path 15. If he decides to continue on the primary path 15, and assuming he hits target 41, he moves his piece along path 15 until coming to target 43 which he must hit in order to place his position indicating piece on the ferry 44. If he fails to hit the target 43, he must return his position indicating piece to the space preceding targets 39 and 40. If he hits target 43, he may place his position indicating piece on the driven ferry 44, which is driven by a motor 45, the details of which are shown in FIG. 4.

For simplicity, motor 45 constitutes a rubber band driven, spool-type motor comprising a spool 46, a rubber band 47 frictionally attached to the bottom of the spool by a pin 48, and a crank 49 attached to the upper end of the rubber band and resting on the top 50 of the motor housing 51. The spool 46 is located and mounted via bearings 52 and 53 of housing 51. A flexible member such as string or thread 54 is wrapped about the spool 46 and is attached to the ferry 44, which is retained in a loading position by a loop **44*a* on the ferry and which is wedged under a simulated dock and released by pushing the ferry forward on the target board 10. In use, the crank 49 is wound to twist the rubber band 47 and, via its connection through pin 48 to the spool 46, the rubber band is operable to turn the spool and thereby draw the string 54 toward the motor housing, thereby pulling the ferry 44** therealong.

As shown in FIG. 1, a target 55 is disposed in the path of the ferry 44. Before the ferry is released with the player's position indicating piece thereon, a projectile aiming and releasing apparatus is controlled by the opponent. When the ferry is released, the opponent aims and releases a projectile in an attempt to hit target 55. If the projectile misses, the ferry conveys the position piece to the finish 14 and the aiming and releasing apparatus is used by the opponent for his run around the paths, in the same manner. If the projectile hits the target 55, it is held upright therein, and it is operable to stop the motion of the ferry 44. In this case, the driver must return ferry 44 to its starting position and move his position indicating piece to the alternate land route 18, and particularly to the space just behind target 56.

When the player gets to targets 57 and 58 he moves his position indicating piece in the direction indicated by the arrows indicated by these targets. If the player hits target 57, he moves along alternate path 20, hitting the targets in order to advance his position indicating piece. If he misses target 59, he moves his piece to the flat tire area as indicated on the target board 10, and must hit targets 60 or 61 in order to move forwardly therefrom. If he hits target 59, he moves his position indicating piece on into the space preceded by targets 62 and 63.

Figure 3:
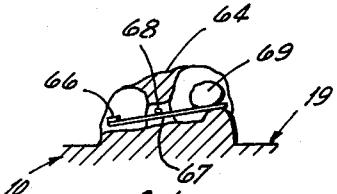
FIG. 3 is a cross-sectional view taken along lines 3—3 of FIG. 1.

If the player on the other hand hits smaller target 58, he proceeds around the mountain 64, stopping at target 65 at which point he delivers control of the projectile aiming and releasing mechanism to the opponent who now has an opportunity to obstruct the alternate path 19 by hitting target 66. Target 66 is mounted on one end of a lever arm 67 which is pivoted about point 68, and the other end of which is located beneath an obstruction, such as a rock 69. If target 66 is hit, the lever 67 pivots in a counterclockwise direction as viewed in FIG. 3 to discharge the rock 69 onto the path 19 and thereby obstruct further movement of the player's position indicating piece. At this point, the driver/player must return to the space preceding targets 57 and 58 and must thereafter continue along alternate path 20. If, on the other hand, the opponent misses target 66, the player is free to move along alternate path 19 hitting the targets as indicated on the target board to advance his position indicating piece to the finish point 14.

Once the player has reached the finish point 14, he totals his score by adding the total number of projectile releases, plus any penalties he has received, (such as for example by taking a penalty at the hinged bridge 30 in order to advance the piece past the bridge). The opponent then takes the remaining position indicating piece and completes a similar run through the target board, with the first driver now taking over the projectile aiming and releasing mechanism at the bridge 30, at the ferry 44, or at the mountain area 64. The player finishing with the least number of "gallons", as represented by the projectile releases and penalties, is the winner.

Projectile Aiming and Releasing Mechanism

The projectile aiming or releasing apparatus 11, as shown in FIG. 5, includes a housing having an upper housing portion 75, a column portion 76 and a lower housing portion 77 which is joined to the upper portion by the column 76. The upper housing portion is fitted with a projectile retaining tube 78, mounted in the housing at a slight angle with respect to the vertical. That is, the upper end of the tube is reclined slightly forwardly, to the right of the lower end as viewed in FIG. 5. The inside diameter of the tube 78 is slightly greater than the outside diameter of the tube 28 surrounding the projectile 26 (FIG. 9). Thus, the projectile resides in the tube and rests against the side 79 thereof, due to the inclination. This very slight inclination permits the projectile to always rest against the side 79 of the tube and, when the projectile is released, it is thus released from a common surface 79. If the tube was located vertically, the tolerance between the projectile 26 and the inside diameter of the tube 78 would result in an inherent inaccuracy when the projectile was dropped as it could not be insured that the projectile would be dropped from exactly the same side of the tube each time.

Figure 7:
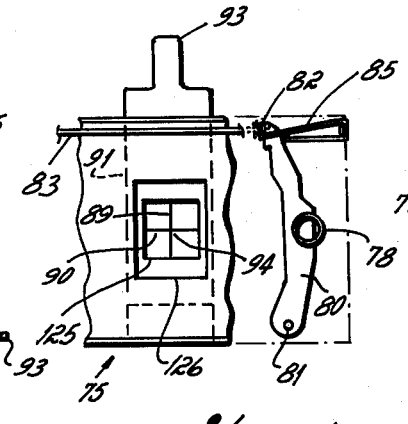
FIG. 7 is a cross-sectional view taken along lines 7—7 of FIG. 5.

The release mechanism further includes a blocking lever 80, pivoted at 81 to one side of the housing and having its other end attached at 82 to a cable 83 for pivoting the lever 80. As shown in FIGS. 5 and 7, the tube 78 is provided with a slot 84 and the blocking lever 80 is positioned to normally reside within the slot, thereby blocking a portion of the tube and preventing the passage therethrough of any projectile residing in the tube. In order to maintain the lever in the position as shown in FIG. 7, a spring or a rubber band 85 is attached to the lever 80 at the end 82 thereof to bias the lever into its normal projectile blocking position. Thus, when a projectile is placed in the tube 78 from above, the projectile is only released therefrom when the cable 83 is drawn rearwardly to pivot the lever 80 about point 81 and thereby disengage from the tube 78, permitting the projectile to be released. The cable 83 extends rearwardly from the lever 80 through the upper housing 75 downwardly through the column 76 and then rearwardly through the lower housing 77 to lever arm 86. To prevent binding of cable 83, and to serve in guiding the cable, a flexible cable covering 83a is used at the cable binding points. The cable 83 easily slides through covering 83a.

Figure 8:
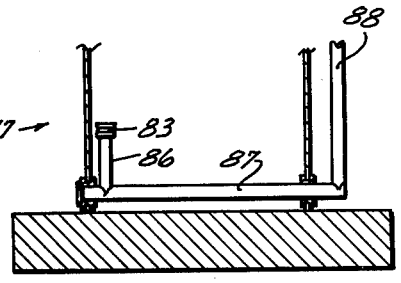
FIG. 8 is a cross-sectional view taken along lines 8—8 of FIG. 5.

Lever arm 86 is attached to pivot rod 87 which extends outwardly of the lower housing 77 and is attached to trigger arm 88. When it is desired to release the projectile from the tube 78, the trigger arm 88, shown in FIG. 8, is pivoted rearwardly, thereby pivoting rod 87 and lever arm 86 rearwardly, as well as connected cable 83 so as to pivot the lever 80 outwardly of the tube.

Figure 6:
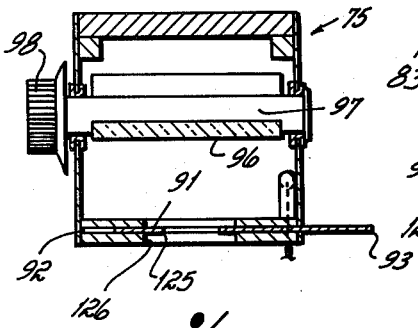
FIG. 6 is a cross-sectional view taken along lines 6—6 of FIG. 5.

The optical sighting apparatus, as best seen in FIG. 5 and FIG. 6, is constructed to provide a reflected target image in the same orientation as the actual target and superimposed with intersecting cross-hairs thereon. The cross-hair structure is best seen in FIG. 7 and comprises cross-hairs 89 and 90 mounted in slide 91 which is disposed in slots 92 within the upper housing 75, as shown in FIG. 5. Slide 91 has an adjusting tab 93 thereon which extends outwardly of the housing 75 and which can be grasped to slide the slide 91 across the housing, thereby adjusting the orientation of cross-hair 90. It should be noted that the intersection 94 of the cross-hairs 89 and 90 is not coaxial with either of the tube 78 or the intended projectile path as indicated by the dotted line in 95. Rather, the cross-hair intersection is located rearwardly of the tube 78 and the intended projectile path 95.

A rotatable mirror 96 is mounted on a rotating rod 97 at the forward end of the upper housing 75. One end of the rod 97 extends outwardly of the housing 75 and is provided with an adjusting knob 98 for rotation of the mirror. Rotation of the knob 98, and consequently of the mirror 96, is effective to vary the orientation of cross-hair 89 on the viewed target image.

As shown in FIG. 5, light is reflected from the actual target along an optical path 100 up through the cross-hair aperture and onto the mirror 96. From mirror 96, the optical path 100 is directed rearwardly to a second mirror 105 mounted at approximately a 45° angle with respect to the horizontal disposition of the upper housing portion 75. From mirror 105, the optical path 100 is directed downwardly through column 76 to impinge on a third mirror 106 mounted in the lower housing 77 and at a 45° angle with respect to the general horizontal disposition of the lower housing 77. From third mirror 106, optical path 100 is directed rearwardly to a fourth mirror 107, also disposed at a selected predetermined angle in the lower housing 77. Mirror 107 may not be disposed exactly at 45° due to the desirability of reflecting the image along optical path 100 upwardly at a comfortable viewing angle through the eyepiece 108. Thus as has been described, the target image is reflected upwardly through the cross-hairs and then by mirrors 96, 105, 106 and 107 through the projectile aiming and releasing apparatus 11, finally upwardly to a position such as at 109 where the image, with the cross-hairs 98 and 90 imposed thereon, can be viewed. When the projectile aiming and releasing mechanism is properly coordinated, as indicated by the superimposed cross-hairs with respect to a target, the trigger arm 88 can be pulled to release a projectile to fall directly onto the target.

In order that the cross-hairs and the mirror 96 can be appropriately adjusted, a testing area 115 is provided on the target board 10. The testing area includes a hinged lid 116 which can be pivoted to expose a target 117 of relatively large dimensions and filled with a soft yieldable substance such as modeling clay. The testing area also includes test targets of diminishing size at 118, 119, and 120. Further, in connection with the testing area, a projectile aiming and release apparatus stop or locating member 121 is disposed on a lower edge of the target board 10. In use, the aiming and releasing apparatus 11 is positioned with a lower surface 122 thereof (FIG. 5) against the stop or locating member 121. A viewer then slides the apparatus 11 along the locating member 121 until the target 117 is centered by the cross-hairs imposed thereon as viewed. At this point, the viewer pulls the trigger arm 88 to release a projectile from the tube 78. The projectile falls into the yieldable substance of target 117 and is removed, leaving a hole therein. If the cross-hairs, as now viewed through the aiming and releasing apparatus, (which has not been moved) are centered in the crater left by the projectile, the aiming and releasing mechanism is "sighted in" or zeroed. If, however, the cross-hairs are off center, they are adjusted in a left or right direction by means of moving the slide 91 or they are adjusted vertically (as viewed from eyepiece 108) by rotation of the mirror 96 until the cross-hairs are centered in the crater. The yieldable substance is then smoothed over and the projectile is reloaded in the tube 78 and released, all having been accomplished without moving the apparatus 11. At this point, the projectile falls into the yieldable target 117 and is removed. As viewed through eyepiece 108, the cross-hairs should be centered in the crater. If not, the process is repeated until the cross-hairs are centered in the crater. To facilitate repeatability, consistency and accuracy with respect to the sighting in procedure, it should be noted that the slide 91 is provided with a cross-hair aperture 125 which is somewhat smaller than a cooperating aperture 126 in the lower portion of the upper housing 75 in which the slide is mounted. The testing area 115 is also constructed to have a rectangular shape which corresponds to the rectangular shape of the cross-hair aperture 125.

The size of the rectangular testing area 115 is constructed so that the complete rectangular testing area can be viewed through the aperture 125 and thus through the eyepiece 108. Positioning the rectangular testing area 115 in the same position within the aperture 125 as viewed will insure consistent results of the sighting in process. This centered position is accomplished, once the apparatus 11 is in the appropriate general position, by moving the viewing point, i.e., the eye of the operator, slightly, to cause centering of the test area. Of course, this "centering" is not available for game targets and the player must be careful to view from the same position each time to insure a hit. Thus a degree of skill is required for consistency in avoiding this parallax problem.

The viewing and adjusting apparatus as herein described when combined with the inclined tube 78 and the projecting mechanism provides a highly accurate apparatus which is consistently operable to drop a projectile onto a very small target. A high degree of skill and accurate results can be obtained with relative little experience.

Providing a further degree of difficulty, however, is the fact that not all targets are located in the same horizontal plane. For example, the target 36, associated with the bridge mechanism of the target board 10, and the target 66, associated with the mountain and obstructing rock mechanism of the target board 10, are located in different vertically spaced or in different horizontal planes as shown in FIG. 5. Line 130 indicates the normal level of targets on the target board 10, and line 131 indicates the vertical disposition or level of the elevated targets such as 36 and 66. As shown in FIG. 5, when the apparatus 11 remains unmoved, the projectile path 95 extends through level 131 to level 130. The optical path 100, however, is not coaxial with the path 95, but is inclined thereto, and thus meets the horizontal plane 131 of the elevated targets at a point 132 which is rearwardly of the intersection 133 of the path 95 and the horizontal plane 131. The optical path 100, however, coincides with the projectile path 95 at the normal target level 130 and more particularly at target impact point 134. Thus, after the projectile aiming and releasing mechanism 11 has been zeroed, positioning the apparatus 11 so as to line up optically with an elevated target on level 131 would move the projectile path 95 forwardly a distance equal to the distance between the points 132 and 133, and the projectile would miss the elevated target. Thus, when intending to hit an elevated target, the optical alignment of the apparatus 11 must be set up that the cross-hair intersection 94 is slightly beneath the intended target impact point (a distance equal to that between points 132 and 133). As shown in FIG. 5, then, in order to hit the point 133, the optical path must intersect the level 131 of the elevated targets at a point lower than (as viewed through eyepiece 108) or to the left of (as in FIG. 5) the actual target or impact point. Thus, the inherent parallax differential between the optical path 100 and the actual projectile path 95, when considering targets at different levels, provides a difficulty requiring further skills in the handling and sighting of the apparatus and thereby adds to the complexity and challenge of the amusement device provided by the invention.

As will be appreciated, of course, a target board 11 could be adapted to any number of differing targets both in size and in elevation, and a number of target boards could be provided with different targets or different game or amusement themes, and all such target boards utilized with the same aiming and releasing mechanism 11.

All of these and other advantages and modifications will become readily apparent to those of ordinary skill in the art without departing from the scope of this invention, and the applicant intends to be bound only by the claims appended hereto.

I claim:

1. Amusement apparatus of the type including a target board having a plurality of targets thereon and a projectile aiming and releasing means for holding a projectile above said target board and for releasing an aimed projectile, said apparatus further comprising:

indicia on said target board defining a first primary path, a portion of said targets disposed proximate portions of said first primary path and adapted to receive released projectiles;

indicia on said target board defining a plurality of alternate paths intersecting said first primary path at respective positions, another portion of said targets disposed proximate portions of said alternate paths;

position indicating means intermittently movable along said paths;

each of said first and said alternate paths ending at a common destination point, each of said alternate paths comprising a further effective distance thereto than said first primary path; and at least two targets of varying size disposed proximate a single intersection between said first path and an alternate path;

said position indicating means being movable along said first path, from said intersection, in response to a projectile hit on a smaller one of said targets at said intersection, and along the alternate path, from said intersection, in response to a projectile hit on a larger one of said targets at said intersection.

2. Apparatus as in claim 1 wherein a portion of said primary path comprises a driven element adapted for receiving one of said position indicating means and for moving said position indicating means along said primary path.

3. Apparatus as in claim 2 further including a stop target means disposed in the path of said driven element, said stop target means adapted for receiving an aimed projectile and, in combination with a projectile therein, for holding said driven element against movement along said primary path.

4. Apparatus as in claim 2 further including biased winch means for moving said driven element.

5. Apparatus as in claim 1 further including means for interrupting the movement of a position indicating means along said primary path, and target means operatively connected to said interrupting means for operating said interrupting means in response to a projectile hit on said target means.

6. Apparatus as in claim 5 wherein said interrupting means comprises a bridge adapted to receive a position indicating means, said bridge being pivoted at one end, and another end thereof operatively connected to said target means, said target means, when actuated by a projectile hit thereon, pivoting said bridge about said one end and thereby interrupting the movement of a position indicating means on said bridge.

7. Apparatus as in claim 1 further including means for obstructing said first primary path, and movable target means operatively associated with said obstructing means for operating said obstructing means in response to a projectile hit on said movable target means.

8. Apparatus as in claim 1 wherein said target board includes means for testing said projectile aiming and releasing means and including:

a yieldable target area for receiving a projectile and for indicating the point of impact of a projectile thereon; and locating means operatively associated with said target board for initially positioning said aiming and releasing apparatus in operative alignment with said yieldable target area.

9. Apparatus as in claim 1 wherein said targets are in different horizontal elevations.

10. Apparatus as in claim 1 wherein said projectile aiming and releasing means includes:

a housing having an elevated portion and a lower portion joined by a column;

a projectile holding tube mounted in the upper portion of said housing at an angle inclined from the vertical;

means for selectively blocking said tube and for holding a projectile therein;

cross-hair sighting means disposed in said upper housing portion in other than coaxial relationship with said tube, said cross-hair sighting means comprising intersecting perpendicular cross-hairs mounted on a slide movable in a horizontal plane;

a first mirror rotatably mounted on a horizontal axis above said cross-hairs, the axis of rotation thereof being parallel to one of said cross-hairs, said first mirror reflecting rearwardly a target image with said cross-hair intersection imposed thereon;

a second mirror operatively disposed rearwardly of said first mirror in said upper housing portion for receiving said target image and reflecting it in a downwardly direction through said column;

a third mirror operatively disposed in said lower housing receiving said target image from said second mirror and reflecting said target image rearwardly;

a fourth operatively disposed mirror in said lower housing for receiving said target image from said third mirror and directing said target image upwardly for viewing through an eyepiece, said target image reflected by said fourth mirror having the same orientation of an actual target beneath said upper housing portion; and trigger means for actuating said blocking means to release a projectile from said tube.

11. Apparatus as in claim 10 wherein one of said targets is in a different horizontal plane than another of said targets, the cross-hair intersection imposed on said one target coinciding with a path of a projectile released from said projectile aiming and releasing means, and the cross-hair intersection imposed on said another target being spaced from said projectile path.

12. Apparatus as in claim 1 wherein said projectile comprises an elongated rod having a blunt end thereon and a plurality of said targets comprise apertures for receiving said rod.

13. Apparatus as in claim 1 wherein one of said targets is at a different elevation, with respect to said target board as another of said targets, and wherein said projectile aiming and releasing mechanism includes means for dropping an aimed projectile along a projectile path, and means for viewing a target and for reflecting a target image with a cross-hair intersection imposed thereon, the cross-hair intersection imposed on said one target coinciding with a path of a projectile released from said projectile aiming and releasing means, and the cross-hair intersection imposed on said another target being spaced from said projectile path.

* * * * *

UNITED STATES PATENT AND TRADEMARK OFFICE

CERTIFICATE OF CORRECTION

PATENT NO. : 4,101,127

DATED : July 18, 1978

INVENTOR(S) : Glenn W. Isgrig

It is certified that error appears in the above-identified patent and that said Letters Patent are hereby corrected as shown below:

The title should be "Board Game Having a Plurality of Targets"

Column 2, line 58, "movedirecting" should be --move-directing--

Column 3, line 51, "board" should be --boards--

Column 6, line 29, "tube 78" should be --tubes 78--

Column 6, line 61, "cross-hairs 98" should be --cross-hairs 89--

Column 8, line 25, delete "up" and insert therefor --so--

Signed and Sealed this

*Third* Day of *July 1979*

[SEAL]

*Attest:*

*Attesting Officer*

LUTRELLE F. PARKER

*Acting Commissioner of Patents and Trademarks*